US010082758B2

(12) United States Patent
Yoshii

(10) Patent No.: US 10,082,758 B2
(45) Date of Patent: Sep. 25, 2018

(54) DEVELOPER CASE AND IMAGE FORMING APPARATUS INCLUDING THE SAME

(71) Applicant: KYOCERA Document Solutions Inc., Osaka (JP)

(72) Inventor: Tatsuhiko Yoshii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/553,596

(22) PCT Filed: Dec. 11, 2015

(86) PCT No.: PCT/JP2015/084808
§ 371 (c)(1),
(2) Date: Aug. 25, 2017

(87) PCT Pub. No.: WO2016/143212
PCT Pub. Date: Sep. 15, 2016

(65) Prior Publication Data

US 2018/0052414 A1 Feb. 22, 2018

(30) Foreign Application Priority Data

Mar. 11, 2015 (JP) ..... 2015-047844

(51) Int. Cl.

| | |
|---|---|
| ***G03G 15/00*** | (2006.01) |
| ***G03G 15/08*** | (2006.01) |
| ***G03G 21/16*** | (2006.01) |
| ***G03G 21/18*** | (2006.01) |

(52) U.S. Cl.
CPC ..... *G03G 15/5075* (2013.01); *G03G 15/0863* (2013.01); *G03G 15/0875* (2013.01); *G03G 21/1657* (2013.01); *G03G 21/1885* (2013.01)

(58) Field of Classification Search
CPC ..... G03G 15/00; G03G 15/0875; G03G 15/5075; G03G 21/16; G03G 15/0863; G03G 21/1657; G03G 21/1885
See application file for complete search history.

(56) References Cited

FOREIGN PATENT DOCUMENTS

JP 2006-227145 A 8/2006

*Primary Examiner* — Hoang Ngo
(74) *Attorney, Agent, or Firm* — Studebaker & Brackett PC

(57) ABSTRACT

A developer case (10) according to the present invention includes a case main body (30) and an RF tag (36, 37). The case main body (30) contains developer and is attached to an apparatus main body (2, 71) which includes a communication device (14). The RF tag (36, 37) is arranged at the case main body (30) and makes wireless communication with the communication device (14) within a communicable area (A1, A2) around the communication device (14). The case main body (30) includes a plurality of attachment parts (41*a*, 41*b*) opposed to the communication device (14) in a state where the case main body (30) is attached to the apparatus main body (2, 71). The RF tag (36, 37) is arranged at one of the plurality of attachment parts (41*a*, 41*b*) according to the communicable area (A1, A2) unique to the RF tag (36, 37).

8 Claims, 8 Drawing Sheets

DEVELOPER CASE AND IMAGE FORMING APPARATUS INCLUDING THE SAME

TECHNICAL FIELD

The present invention relates to a developer case suitably used for a copying machine and a printer, and an image forming apparatus which includes the developer case.

BACKGROUND ART

An image forming apparatus, such as a copying machine and a printer, develops a latent image on an image carrier by using developer (toner) to be supplied from a development device. The developer is contained in a developer case, and is supplied from the developer case to the development device.

A process cartridge (toner container) disclosed in Patent Document 1 is attached to an image forming apparatus main body. An IC tag which stores information related to a remaining toner amount is attached to the process cartridge. The apparatus main body is provided with a controller which makes wireless communication with the IC tag via an antenna. The controller receives an information signal from the IC tag, and causes a display part to display the information related to the remaining toner amount.

PRIOR ART DOCUMENT

Patent Document

[Patent Document 1] Japanese patent laid-open publication No. 2006-227145

SUMMARY OF INVENTION

Technical Problem

Generally, the IC tag (RF tag) makes the wireless communication with the antenna within a semispherical communicable area around the antenna. To secure appropriate wireless communication, the IC tag of the process cartridge (toner container) disclosed in Patent Document 1 is arranged coaxially with the antenna of the controller.

By the way, a specification of the IC tag (RF tag) may be changed according to a type of the image forming apparatus. For example, an RF tag of high security capability (confidentiality) is used for a highly functional image forming apparatus, and a low-cost RF tag is used for a popular image forming apparatus. However, when the specification of the RF tag is changed, it is necessary to change a design of a toner container to make appropriate wireless communication with an antenna. Hence, it is necessary to manufacture toner containers of different shapes per type of the image forming apparatus, and there is a problem of an increase in manufacturing cost.

If the specification of the RF tag is changed without changing the design of the toner container, it is necessary to change a position of the antenna at an apparatus main body side to establish appropriate wireless communication with the RF tag. Hence, there is another problem of an increase in cost caused by changing the position of the antenna and an increase in a size of the apparatus main body caused by securing an installation space.

To solve the above-mentioned problem, the present invention provides a developer case in which an RF tag of a different specification is installed without changing a design, and an image forming apparatus which includes the developer case.

Solution to Problem

A developer case according to the present invention includes a case main body and an RF tag. The case main body contains developer and is attached to an apparatus main body which includes a communication device. The RF tag is arranged at the case main body and makes wireless communication with the communication device within a communicable area around the communication device. The case main body includes a plurality of attachment parts opposed to the communication device in a state where the case main body is attached to the apparatus main body. The RF tag is arranged at one of the plurality of attachment parts according to the communicable area unique to the RF tag.

An image forming apparatus according to the present invention includes the above developer case.

Advantageous Effects of Invention

According to the present invention, it is possible to install an RF tag of a different specification to a single case main body without changing a design.

DESCRIPTION OF EMBODIMENTS

A preferred embodiment of the present invention will be described below with reference to the accompanying drawings. In this regard, the preferred embodiment will be described based on a direction shown in each drawing for ease of description. Further, an "upstream", a "downstream" and terms similar to the "upstream" and the "downstream" indicate the "upstream", the "downstream" and concepts of the "upstream" and the "downstream" in a conveying direction of a toner (developer).

Figure 1:
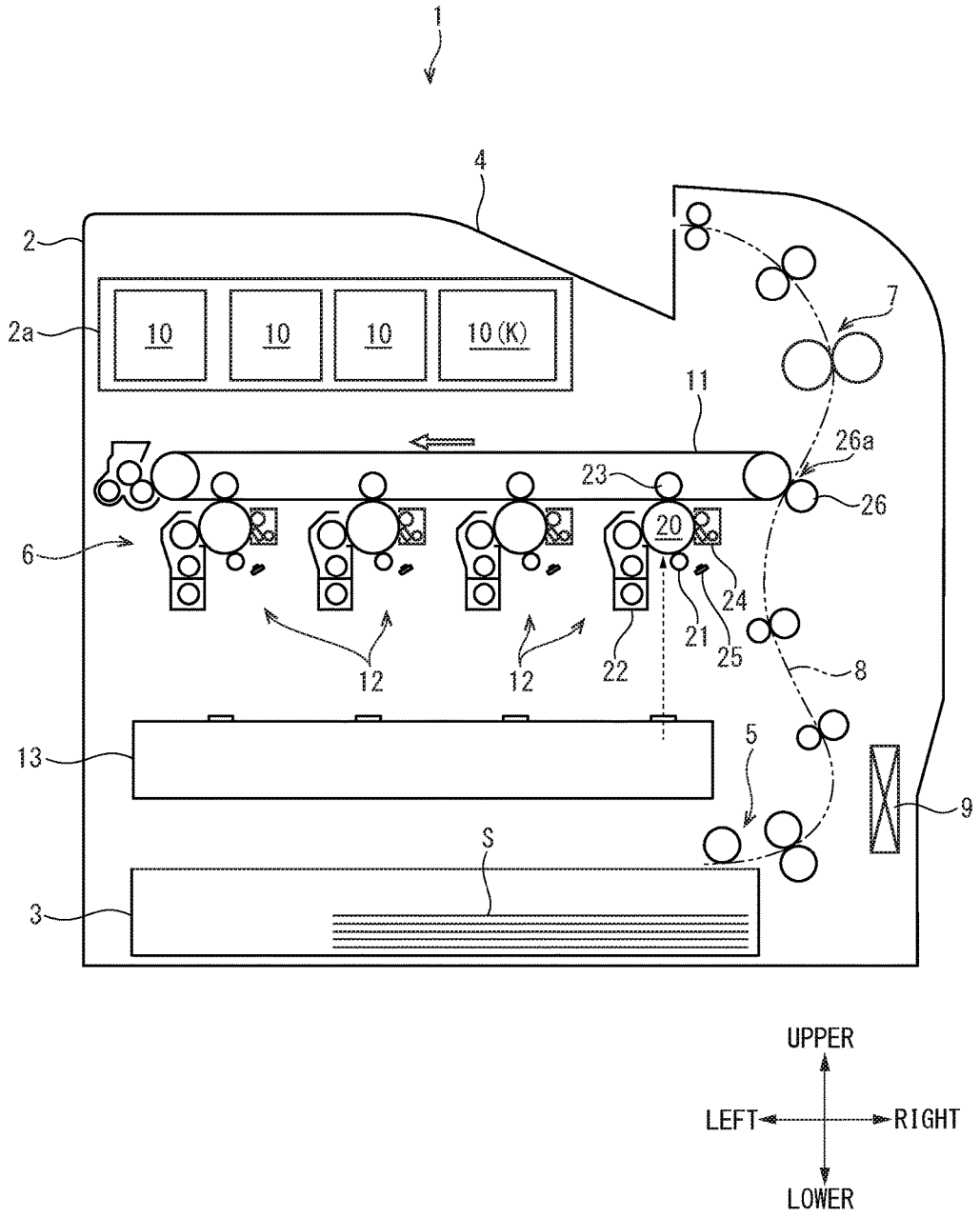
FIG. 1 is a front view schematically showing an inner structure of a color printer according to an embodiment of the present invention.

An entire configuration of a color printer 1 as an image forming apparatus will be described with reference to FIG. 1. FIG. 1 is a front view schematically showing an inner structure of the color printer 1.

The color printer 1 includes an apparatus main body 2, a sheet feeding cassette 3 and an ejection tray 4. The apparatus main body 2 is formed in a substantially rectangular box shape. The sheet feeding cassette 3 is provided at a lower part of the apparatus main body 2. The ejection tray 4 is provided at an upper part of the apparatus main body 2.

Further, the color printer 1 includes a conveying part 5, an image forming part 6 and a fixing device 7 inside the apparatus main body 2. The conveying part 5 feeds sheets S in the sheet feeding cassette 3 toward a conveying path 8 extended from the sheet feeding cassette 3 to the ejection tray 4. The image forming part 6 is provided at an intermediate part of the conveying path 8. The fixing device 7 is provided at a downstream side of the conveying path 8. Further, a controller 9 to preside and control the color printer 1 is arranged inside the apparatus main body 2. In this regard, the sheets S are not limited to sheets made of paper, and include resin films and OHP (Over Head Projector) sheets.

The image forming part 6 includes four toner containers 10, an intermediate transfer belt 11, four drum units 12, and an optical scanning device 13. The four toner containers 10 are provided in a row in a left and right direction below the ejection tray 4. The intermediate transfer belt 11 is provided to be able to run in an outlined arrow direction below each toner container 10. The four drum units 12 are provided in a row in the left and right direction below the intermediate transfer belt 11. The optical scanning device 13 is disposed below each drum unit 12.

The four toner containers 10 contain four (yellow, magenta, cyanogen and black) toners (developers). In this regard, the toners may be one-component developer including a magnetic toner or may be two-component developer including a toner and a carrier.

The four drum units 12 are provided to correspond to the respective color toners. Each drum unit 12 is configured to include a photosensitive drum 20, a charging device 21, a development device 22, a primary transfer roller 23, a cleaning device 24 and a static eliminating device 25. In this regard, the four drum units 12 employ the same configuration, and therefore one drum unit 12 will be described below.

The photosensitive drum 20 is formed in a cylindrical shape which can rotate around an axis. The photosensitive drum 20 is in contact with a lower side face of the intermediate transfer belt 11. The charging device 21, the development device 22, the primary transfer roller 23, the cleaning device 24 and the static eliminating device 25 are disposed in a transfer process order around the photosensitive drum 20. The development device 22 is connected with the toner container 10 and receives replenishment of the toner from the toner container 10. The primary transfer roller 23 is disposed above the photosensitive drum 20 across the intermediate transfer belt 11. At a right side of the intermediate transfer belt 11, a secondary transfer roller 26 which forms a secondary transfer nip part 26*a* is disposed.

The controller 9 includes an arithmetic processor (not shown) which controls image forming processing and its related processing based on date and a program stored in memory (not shown).

Hereinafter, an operation of the color printer 1 will be described. The controller 9 executes the image forming processing as follows based on input image data.

Each charging device 21 charges a face of each photosensitive drum 20. The optical scanning device 13 performs exposure (see a broken line arrow in FIG. 1) corresponding to image data on each photosensitive drum 20. Each development device 22 develops an electrostatic latent image arranged on the face of each photosensitive drum 20 to a toner image. Each of four toner images carried by each photosensitive drum 20 is primarily transferred in order on the running intermediate transfer belt 11 by the primary transfer roller 23 to which a primary transfer bias has been applied. Thus, a full-color toner image is formed on the face of the intermediate transfer belt 11.

Meanwhile, the sheet S supplied from the sheet feeding cassette 3 is conveyed on the conveying path 8 and passes the secondary transfer nip part 26*a*. The full-color toner image is secondarily transferred on the sheet S by the secondary transfer roller 26 to which a secondary transfer bias has been applied. The fixing device 7 fixes the full-color toner image to the sheet S. The sheet S after the fixing processing is discharged to the ejection tray 4. Each cleaning device 24 removes the toner remaining on the face of each photosensitive drum 20 after the transfer. Each static eliminating device 25 radiates static eliminating light and eliminates charges of each photosensitive drum 20.

Figure 2:
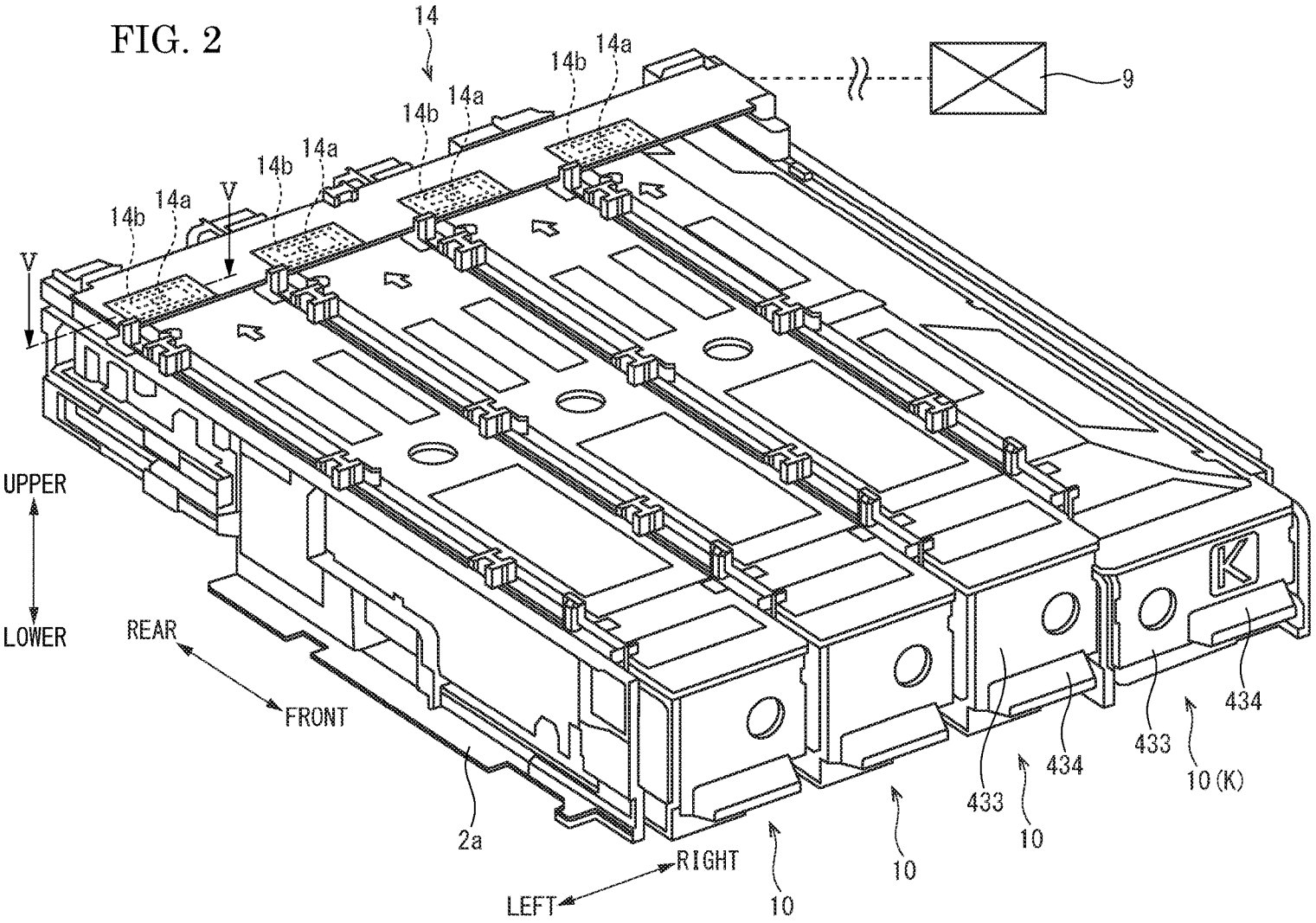
FIG. 2 is a perspective view showing toner containers and an attachment part according to the embodiment of the present invention.
Figure 3:
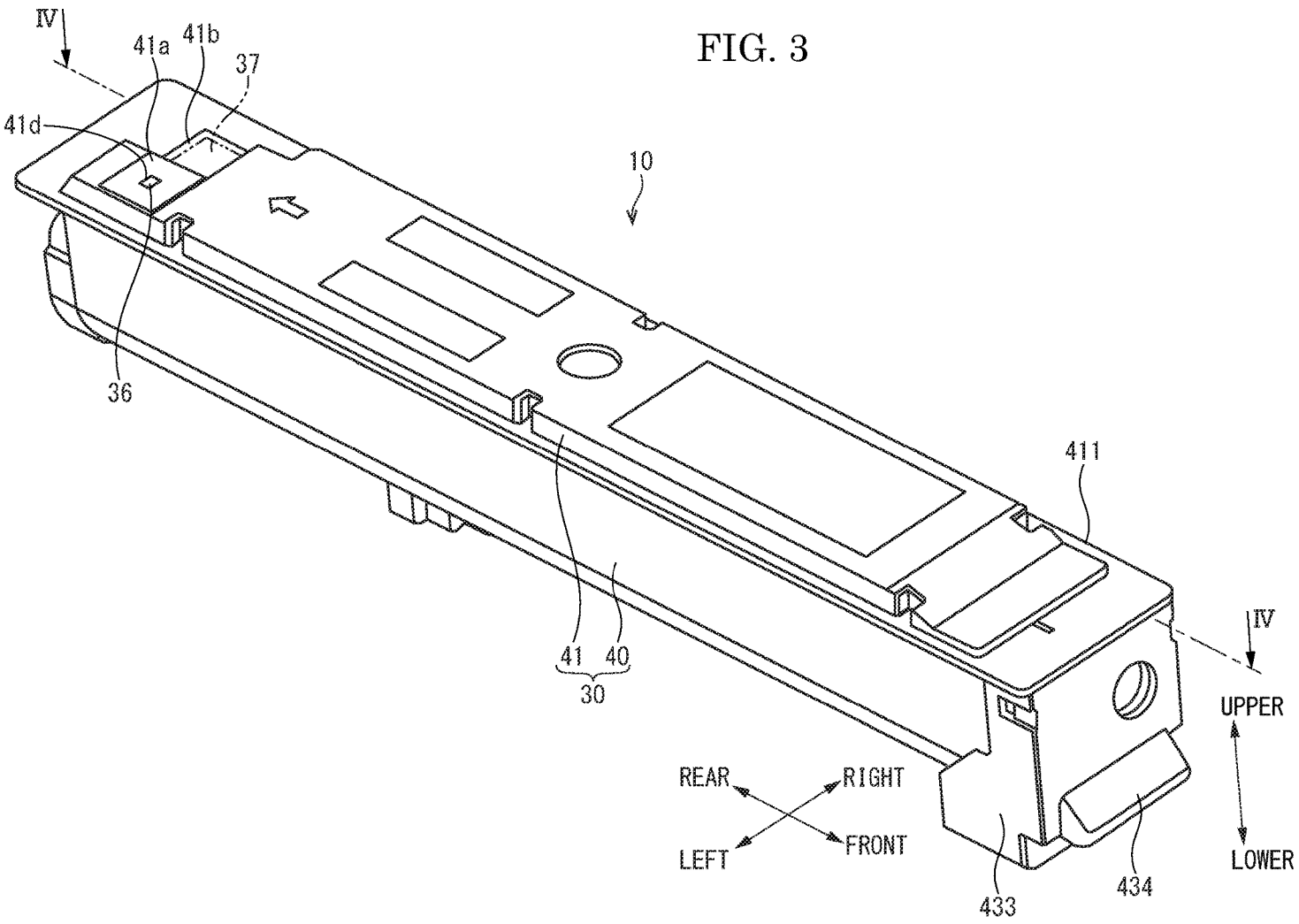
FIG. 3 is a perspective view showing the toner container according to the embodiment of the present invention.
Figure 4:
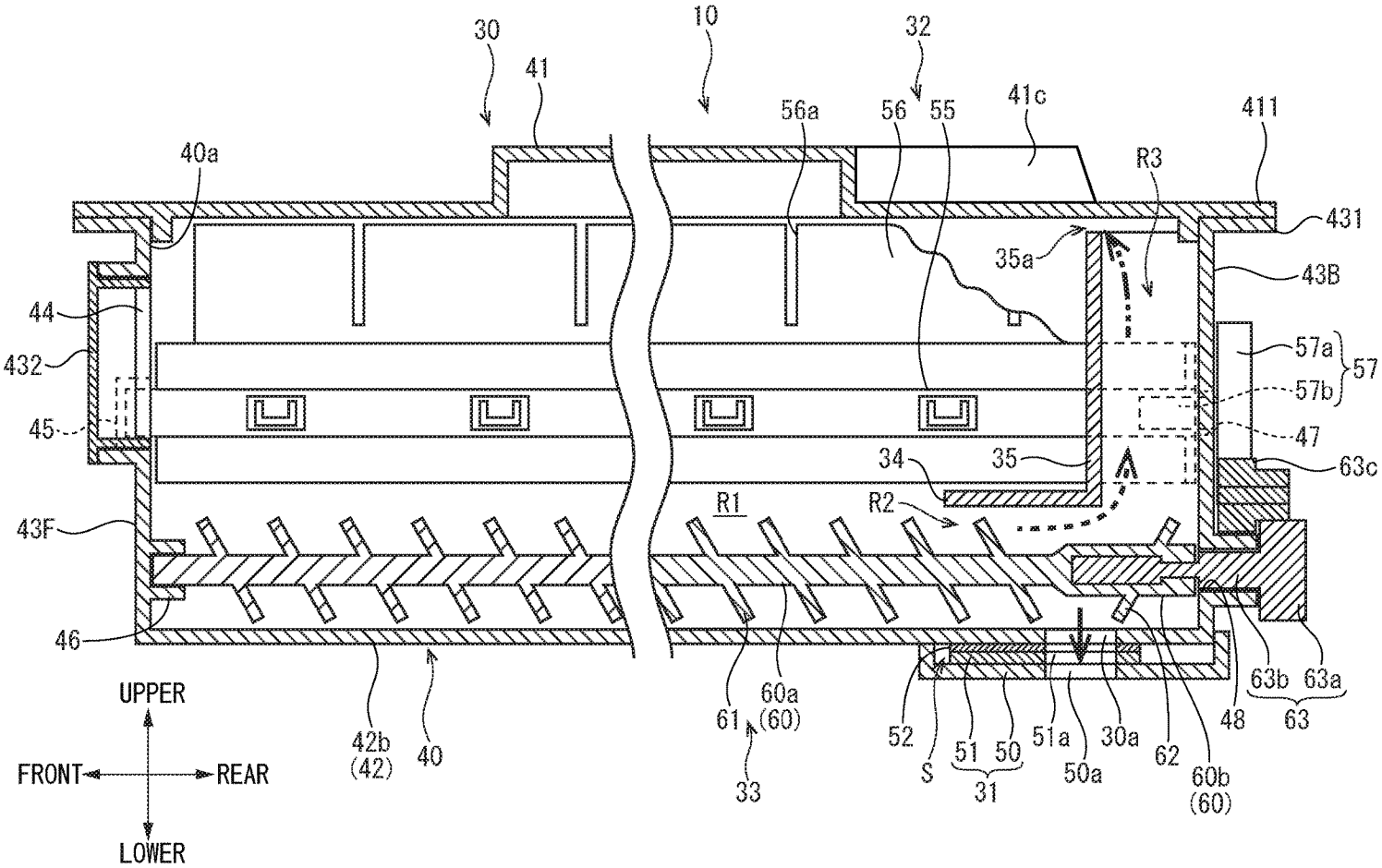
FIG. 4 is a sectional view taken along a IV-IV line in FIG. 3.
Figure 5:
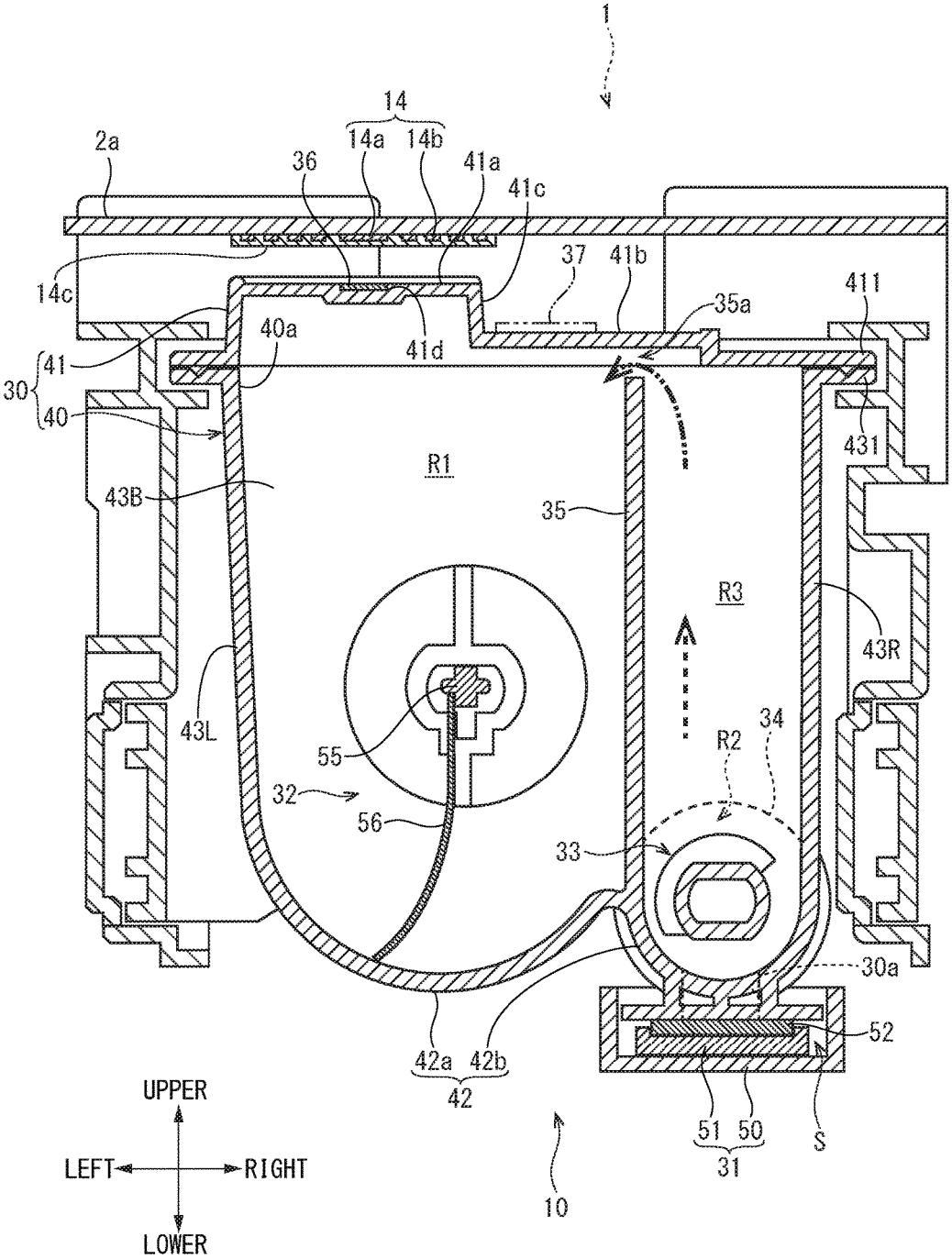
FIG. 5 is a sectional view taken along a V-V line in FIG. 2.

Next, each toner container 10 as a developer case will be described with reference to FIGS. 1 to 5. FIG. 2 is a perspective view showing the toner containers 10 and an attachment part. FIG. 3 is a perspective view showing the toner container 10. FIG. 4 is a sectional view taken along a IV-IV line in FIG. 3. FIG. 5 is a sectional view taken along a V-V line in FIG. 2.

As shown in FIGS. 1 and 2, at the upper part of the apparatus main body 2, an attachment part 2*a* in which the four toner containers 10 are aligned in the left and right direction and attached is provided. Each toner container 10 is supported by the attachment part 2*a* in a slidable state in a front and rear direction. An upper front face of the apparatus main body 2 is provided with an opening/closing cover (not shown) to open and close the attachment part 2*a*. A user executes an operation of attaching and detaching each toner container 10 to and from the attachment part 2*a* by opening the opening/closing cover. At a rear upper part of the attachment part 2*a*, a communication device 14 is arranged. The communication device 14 and an RF (Radio Frequency) tag 36 (described below) arranged at each toner container 10 compose an RFID (Radio Frequency Identifier) system. The communication device 14 will be described prior to description of each toner container 10.

As shown in FIG. 2, the communication device 14 is configured to include four reader substrates 14*a* and four reader antennas 14*b*. The four reader substrates 14*a* and the four reader antennas 14*b* are aligned in the left and right direction and oppose to rear upper faces of the four toner containers 10 attached to the attachment part 2*a*. In this regard, the four reader substrates 14*a* employ the same configuration, and therefore one reader substrate 14*a* will be described below. Similarly, one reader antenna 14*b* will be described below.

The reader substrate 14*a* is configured to include a controlling part (not shown) which controls wireless communication made with the RF tag 36 based on data and a program stored in memory (not shown). The reader substrate 14*a* is electrically connected to the controller 9, and controlled by the arithmetic processor of the controller 9. The reader antenna 14*b* is electrically connected to the reader substrate 14*a*, and forms an electrical closed circuit. The reader antenna 14*b* is arranged to transmit and receive information to and from the RF tag 36. The reader antenna 14*b* is formed in a substantially whorled shape (not shown) which revolves so as to draw a substantially square shape without overlapping on the reader substrate 14*a*.

Next, the toner container 10 will be explained. In this regard, the toner containers 10 which contain the toners of the respective color (yellow, magenta and cyanogen) except black (k) among the four toner containers 10 have the same volume and are set to the same specification. By contrast with this, the toner container 10 (K) which contains the black toner is set to a larger volume than the other toner containers 10, and has a different specification, too. However, the four toner containers 10 differ in the volumes and the specific specifications and employ the same basic configuration, and therefore the toner container 10 which contains the toner of each color except black will be described.

As shown in FIGS. 3 and 4, the toner container 10 is configured to include a case main body 30, a shutter mechanism 31, an agitator 32, a conveyer 33, a first tube 34, a second tube 35, and the RF tag 36. The case main body 30 contains the toner (developer) and includes a discharge port 30*a* through which the toner is discharged. The shutter mechanism 31 is provided to open and close the discharge port 30*a*. The agitator 32 agitates and conveys the toner in the case main body 30. The conveyer 33 conveys the toner in the case main body 30 toward the discharge port 30*a*. The first tube 34 and the second tube 35 are provided in the case main body 30. The RF tag 36 is arranged on an upper face of the case main body 30.

The case main body 30 is detachably attached to the attachment part 2*a* of the apparatus main body 2. The case main body 30 is formed in a substantially cuboid shape which is long in the front and rear direction by using a synthetic resin material, for example. The case main body 30 includes the storing case 40 and a lid 41. The storing case 40 includes sidewalls 43F, 43B, 43L and 43R (see FIGS. 4 and 5) erected around a bottom 42, and is formed in a box shape with an opened upper face. The lid 41 is provided to seal the upper face of the storing case 40. Inside the case main body 30, a storing room R1 in which the toner is stored is arranged (see FIGS. 4 and 5).

As shown in FIG. 5, the bottom 42 includes an agitating recess part 42*a* and a conveying recess part 42*b* which are curved so as to protrude downward when seen from a front view. In a rear lower surface of the conveying recess part 42*b*, the discharge port 30*a* is opened. As shown in FIGS. 4 and 5, at the upper ends of the storing case 40, a case side flange 431 extending outward is arranged. In the front sidewall 43F, a loading port 44 through which the toner is loaded in the storing room R1 is opened (see FIG. 4). The loading port 44 is sealed by a cap 432 (see FIG. 4). As shown in FIG. 3, a cover 433 which covers the loading port 44 is attached to the front sidewall 43F. A grip part 434 which the user grips to attach or detach the toner container 10 is arranged on the cover 433.

As shown in FIG. 4, a cylindrical agitating bearing boss 45 and a conveying bearing boss 46 are arranged in the front sidewall 43F. The agitating bearing boss 45 is arranged so as to protrude on a front face of the sidewall 43F. The conveying bearing boss 46 is arranged so as to protrude on a rear face of the sidewall 43F. In the rear sidewall 43B, an agitating support hole 47 and a conveying support hole 48 are arranged.

As shown in FIG. 3, the lid 41 is formed in the substantially same shape as that of the storing case 40 when seen from the plan view. At an entire periphery of a lower part of the lid 41, a lid side flange 411 is arranged. The lid 41 is disposed such that the lid side flange 411 faces the case side flange 431 (see FIGS. 4 and 5). Both of the flanges 411 and 431 are bonded by an adhesive (or welding processing) to fix the lid 41 to the storing case 40. According to this, the upper face opening 40*a* of the storing case 40 is sealed by the lid 41 (see FIG. 5).

As shown in FIG. 5, the case main body 30 includes two attachment parts 41*a* and 41*b* formed so as to oppose to an opposed face 14*c* arranged on a lower face of the communication device 14 in a state where the case main body 30 is attached to the apparatus main body 2 (attachment part 2*a*). The first attachment part 41*a* and the second attachment part 41*b* are formed on a rear upper face of the lid 41 (see FIG. 3).

As shown in FIGS. 3 and 5, the first attachment part 41*a* is arranged on a left side of the lid 41, and forms a plane of a rectangular shape when seen from the plan view. The first attachment part 41*a* forms a part of an uppermost face of the lid 41. The first attachment part 41*a* is formed right below the communication device 14 in a state where the case main body 30 is attached to the attachment part 2*a* (see FIG. 5). A fitting recess 41*d* is recessed on an upper face of the first attachment part 41*a*. The fitting recess 41*d* is formed in a rectangular shape at a center of the first attachment part 41*a* when seen from the plan view.

The second attachment part 41*b* is arranged at a substantially middle in the left and right direction of the lid 41, and forms a plane of a rectangular shape when seen from the plan view. The second attachment part 41*b* is formed adjacently to a right side of the first attachment part 41*a* and shifted downward with respect to the first attachment part 41*a* (so as to be separated from the communication device 14). Between the first attachment part 41*a* and the second attachment part 41*b*, a step 41*c* is formed (see FIG. 5).

As shown in FIGS. 4 and 5, the shutter mechanism 31 includes a holding member 50 and a shutter 51.

The holding member 50 is attached to a lower face of the conveying recess part 42*b* so as to cover the surroundings of the discharge port 30*a*. An installation space S in which the shutter 51 and the like are disposed is arranged in the holding member 50. A first communication hole 50*a* is opened at a position of the holding member 50 meeting the discharge port 30*a* when seen from a bottom view. The shutter 51 is formed in a substantially rectangular shape when seen from the plan view, and is held in the installation space S. On an upper face of the shutter 51, a seal 52 (made of a synthetic rubber) is fixed. At a rear side of the shutter 51 (seal 52), a second communication hole 51*a* is opened. The shutter 51 is slidable between an opening position at which the second communication hole 51*a* matches with the discharge port 30*a*, and a closed position at which the second communication hole 51*a* is displaced from the discharge port 30*a*.

In a state where the toner container 10 is detached from the attachment part 2*a*, the shutter 51 is biased by a biasing member (not shown) and is kept in the closed position. At this time, the seal 52 comes into close contact with the periphery part of the discharge port 30*a*. Consequently, it is possible to prevent leakage of the toner from the discharge port 30*a*. Meanwhile, in a process of attaching the toner container 10 to the attachment part 2*a*, the shutter 51 engages with an engagement part (not shown) provided to the attachment part 2*a*, and moves from the closed position to the opening position (see FIG. 4). Thus, the discharge port 30*a* connects to a toner conveying path (not shown) which extends from the development device 22 via each of the communication holes 50*a* and 51*a*. Further, the toner discharged from the discharge port 30*a* is replenished to the development device 22 through the toner conveying path.

As shown in FIGS. 4 and 5, the agitator 32 is disposed on the agitating recess part 42*a*. The agitator 32 includes an agitating rotation shaft 55, an agitating blade 56 and an agitating coupling 57.

The agitating rotation shaft 55 has a roughly rectangular section and is formed in a stick shape which is long in the front and rear direction. A front end of the agitating rotation shaft 55 is rotatably supported by the agitating bearing boss 45 with a boss axis (not shown) in between. A rear end of the agitating rotation shaft 55 is rotatably supported in the agitating support hole 47 with the agitating coupling 57 in between.

The agitating blade 56 is formed in a rectangular shape which is long in the front and rear direction by using a synthetic resin film having flexibility. One side in the longitudinal direction of the agitating blade 56 is fixed along a longitudinal direction of the agitating rotation shaft 55. A width dimension of the agitating blade 56 (a dimension in a radial direction of the agitating rotation shaft 55) is set to be longer than a distance which connects an axial center of the agitating rotation shaft 55 and an inner face of the agitating recess part 42*a* (see FIG. 5). Further, on the agitating blade 56, a plurality of cut grooves 56*a* are cut from a side of a free end to a side of the agitating rotation shaft 55 (see FIG. 4).

As shown in FIG. 4, the agitating coupling 57 includes an agitating gear 57*a* and an agitating coupling shaft 57*b*. The agitating gear 57*a* is a so-called spur gear, and is disposed along a rear surface of the sidewall 43B. The agitating coupling shaft 57*b* is provided so as to protrude from a rotation axial center of the agitating gear 57*a*. The agitating coupling shaft 57*b* is inserted in the agitating support hole 47 of the sidewall 43B from a rear side, and is rotatably supported by the agitating support hole 47. A distal end (front end) of the agitating coupling shaft 57*b* is unrotatably coupled to a rear end (axial part) of the agitating rotation shaft 55.

As shown in FIGS. 4 and 5, the conveyer 33 is disposed on the conveying recess part 42*b*. The conveyer 33 includes a conveying rotation shaft 60, a first blade 61, a second blade 62 and a conveying coupling 63.

As shown in FIG. 4, the conveying rotation shaft 60 is formed in a round bar shape which is long in the front and rear direction. The conveying rotation shaft 60 includes a rotation shaft part 60*a* and a fitting shaft part 60*b* which are formed integrally.

The rotation shaft part 60*a* extends from the front end to a proximity of the discharge port 30*a*. A front end of the rotation shaft part 60*a* is rotatably supported in the conveying bearing boss 46. The fitting shaft part 60*b* continues to a rear end of the rotation shaft part 60*a*. The fitting shaft part 60*b* has the same axial center as that of the rotation shaft part 60*a*, and is formed in a hollow cylindrical shape which is thicker than the rotation shaft part 60*a*. The fitting shaft part 60*b* is rotatably supported in the conveying support hole 48 via the conveying coupling 63.

The first blade 61 protrudes in the radial direction from a circumferential face of the rotation shaft part 60*a*, and is formed in a spiral shape along the longitudinal direction of the rotation shaft part 60*a*. The second blade 62 protrudes in the radial direction from a circumferential face of the fitting shaft part 60*b*, and is formed in a spiral shape of one or two turns. The second blade 62 is arranged such that its spiral direction is a reverse direction (reverse phase) to that of the first blade 61. The second blade 62 is formed to have the same diameter as that of the first blade 61 when seen from the front view. The second blade 62 is arranged at a downstream side (rear side) of the discharge port 30*a*. In this regard, the fitting shaft part 60*b* has a larger diameter than that of the rotation shaft part 60*a*, so that the conveying force of the second blade 62 gets smaller than the conveying force of the first blade 61. In this regard, above the discharge port 30*a*, the first blade 61 and the second blade 62 are not provided.

The conveying coupling 63 includes a conveying gear 63*a* and a conveying coupling shaft 63*b*. The conveying gear 63*a* is a so-called spur gear, and is disposed along a rear face of the sidewall 43B. The conveying gear 63*a* is coupled to a drive mechanism (not shown) including a drive gear and a gear train provided in the apparatus main body 2. The conveying gear 63*a* connects (meshes) with the agitating gear 57*a* via an intermediate gear 63*c*. The conveying coupling shaft 63*b* is provided so as to protrude from a rotation axial center of the conveying gear 63*a*. The conveying coupling shaft 63*b* is inserted in the conveying support hole 48 of the sidewall 43B from the rear side, and is rotatably supported in the conveying support hole 48. A distal end (front end) of the conveying coupling shaft 63*b* unrotatably fits to a hollow inner part of the fitting shaft part 60*b* of the conveying rotation shaft 60.

When the toner is consumed by executing the image forming processing, the controller 9 executes an operation of replenishing the toner as follows, by controlling the driving of a drive motor. Drive force of the drive motor rotates the conveying gear 63*a*. The rotation of the conveying gear 63*a* rotates the agitating gear 57*a* via the intermediate gear 63*c*. Thus, the agitating coupling 57 and the agitating rotation shaft 55 integrally rotate around the same axial center. Then, the agitating blade 56 agitates the toner in the storing room R1 while the agitating blade 56 is elastically curves and scrapes the toner attached to an inner face of the agitating recess part 42*a* (refer to FIG. 6). Similarly, the conveying coupling 63 and the conveying rotation shaft 60 integrally rotate around the same axial center. Then, the first blade 61 conveys the toner agitated by the agitator 32 to the discharge port 30*a*. The toner is blocked by the rotation of the second blade 62 and is discharged from the discharge port 30*a* to the development device 22 (see a bold line arrow in FIG. 5).

As shown in FIGS. 4 and 5, the first tube 34 is arranged at a position covering the discharge port 30*a* and formed in a substantially cylindrical shape which extends in the front and rear direction together with a rear end of the conveying recess part 42*b*. Inside the first tube 34, a conveying room R2 which includes a rear end of the conveyer 33 is arranged.

The toner in the storing room R1 is fed into conveying room R2 by the rotating conveyer 33, and is discharged from the discharge port 30*a* to the development device 22 (see FIG. 5). The discharge port 30*a* is covered by the first tube 34, and therefore an excessive amount of the toner is not carried to the discharge port 30*a*. Accordingly, it is possible to prevent the toner from being excessively replenished to the development device 22.

The second tube 35 is formed in a rectangular shape which extends from an upper circumferential face of the first tube 34 to an upper side in a vertical direction along each of the sidewalls 43B and 43R. Inside the second tube 35, an evacuation room R3 which communicates with the conveying room R2 is arranged. Between an upper end (front side and a left side) of the second tube 35 and a lower face of the lid 41, a gap 35*a* to communicate the evacuation room R3 and the storing room R1 is formed.

When the conveyer 33 and the like continue rotating in a state where the toner is jammed in the discharge port 30*a*, the toner to be conveyed is introduced from the conveying room R2 to the evacuation room R3 (see broken line bold arrows in FIGS. 4 and 5). Thus, by evacuating the toner from the conveying room R2 to the evacuation room R3, it is possible to reduce a load acting on the conveyer 33 and a drive motor when the toner continues to be conveyed in a state where the toner discharge failure occurs. Further, when the toner fills the inside of the evacuation room R3, the toner is discharged from the gap 35*a* at the upper part to the storing room R1 (see two-dot chain lines in FIGS. 4 and 5). Hence, the toner filling the inside of the evacuation room R3 does not apply an excessive load to the conveyer 33 and the drive motor. As described above, the conveyer 33 and the drive motor are protected.

Figure 6:
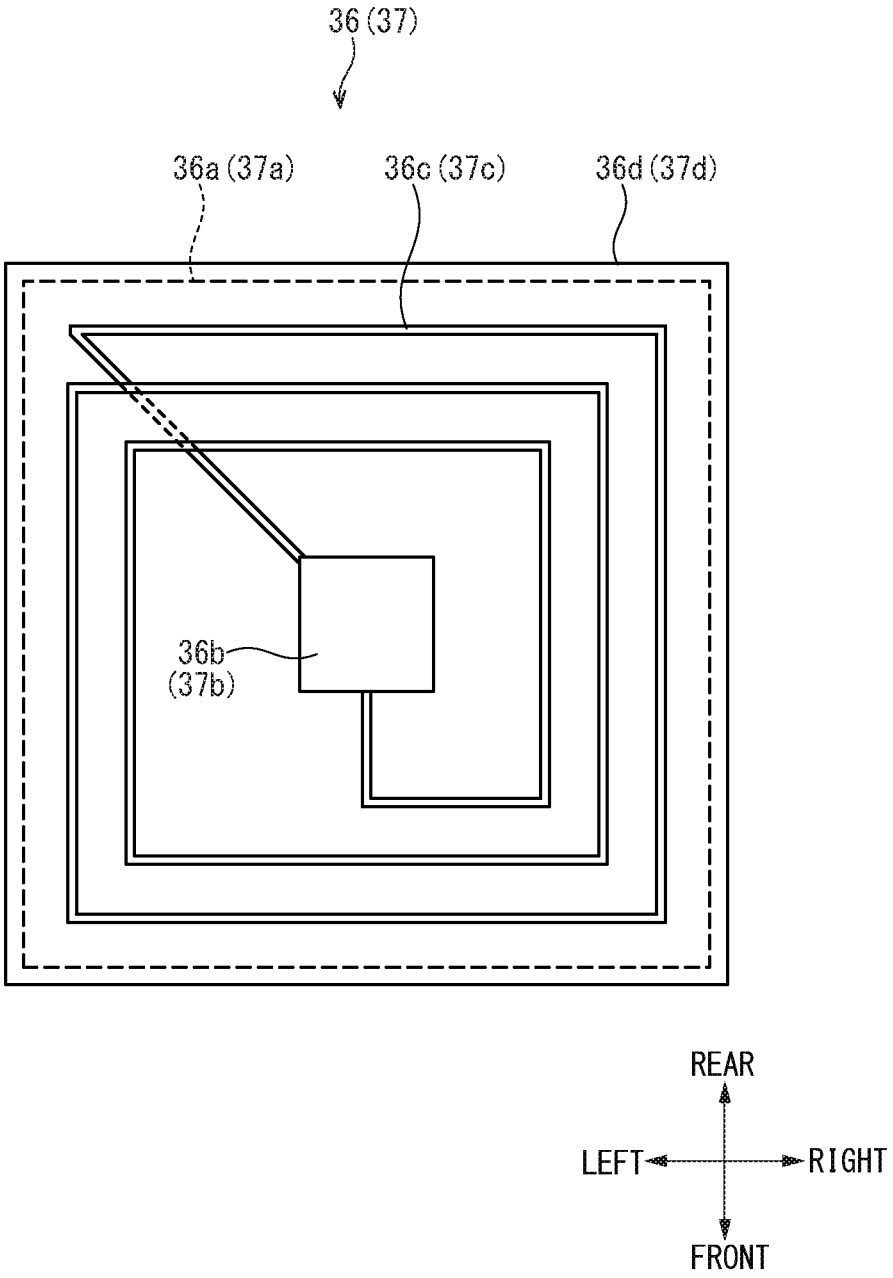
FIG. 6 is a plan view schematically showing a first RF tag or a second RF tag of the toner container according to the embodiment of the present invention.
Figure 7:
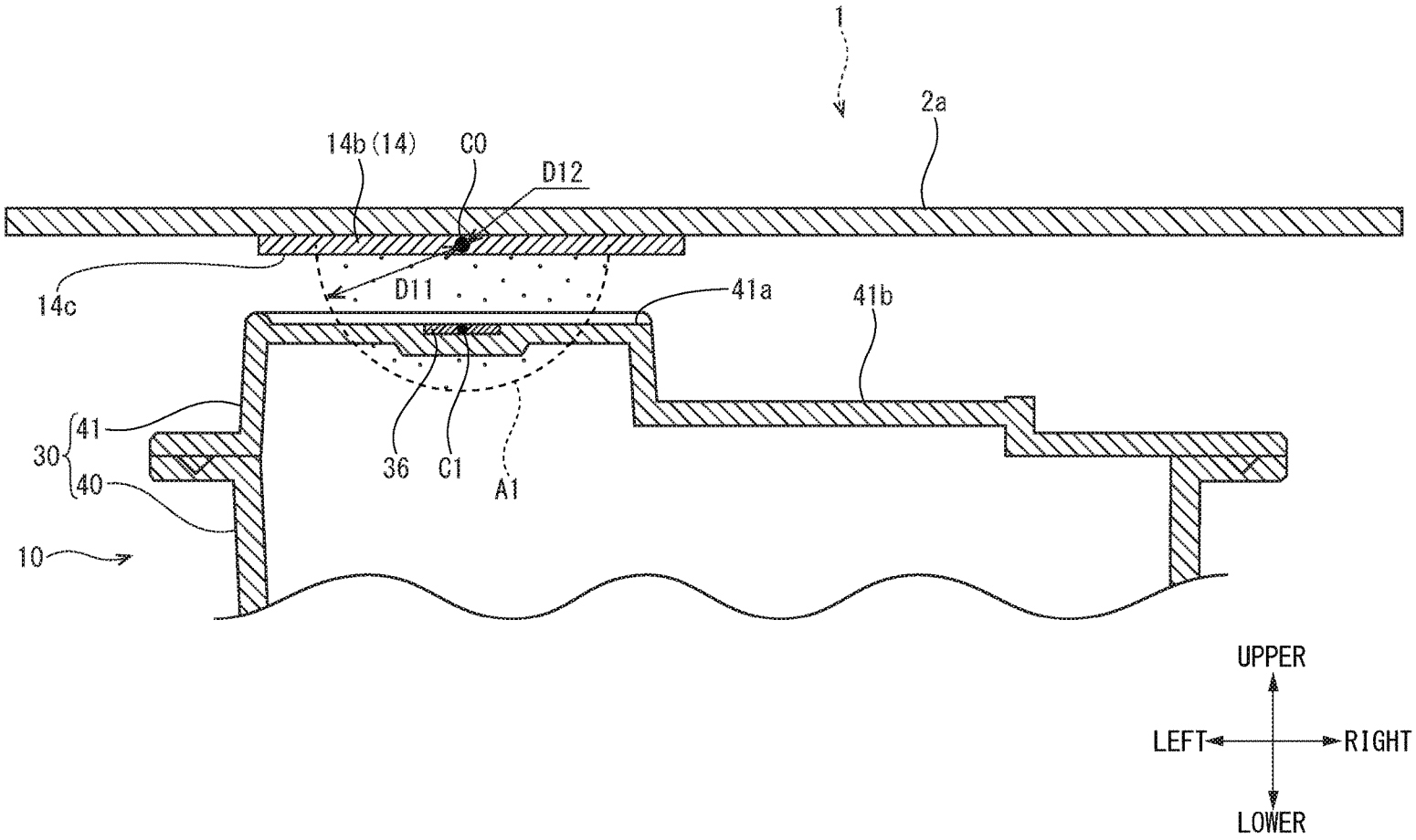
FIG. 7 is a sectional view schematically showing a first communicable area of the first RF tag of the toner container according to the embodiment of the present invention.

Next, the RF tag 36 will be described with reference to FIGS. 5 to 8. FIG. 6 is a plan view schematically showing the RF tag 36. FIG. 7 is a sectional view schematically showing a first communicable area A1 of the (first) RF tag 36. FIG. is a sectional view schematically showing a second communicable area A2 of the (second) RF tag 37.

As shown in FIG. 5, the RF tag 36 of the toner container 10 according to the present embodiment is attached to the first attachment part 41*a*. The RF tag 36 is arranged right below the reader antenna 14*b* of the communication device 14 in a state where the toner container 10 is attached to the attachment part 2*a*. The RF tag 36 is fitted to the fitting recess 41*d* of the first attachment part 41*a*. An upper face of the RF tag 36 forms a substantially same plane as an upper face of the first attachment part 41*a* in a state where the RF tag 36 is fitted to the fitting recess 41*d*.

As shown in FIG. 6, the RF tag 36 is configured to include a base 36*a*, an IC chip 36*b*, a tag antenna 36*c* and a cover 36*d*.

The base 36*a* is formed in a square sheet shape when seen from the plan view, for example. The base 36*a* is formed by using a resin material (such as glass epoxy, phenol or polyimide) with good heat resistance and mechanical strength and a small thermal expansion coefficient. On a back face (lower face) of the base 36*a*, an adhesive layer (not shown) is formed. In this regard, the RF tag 36 is attached to the fitting recess 41*d* by the adhesive layer of the base 36*a*.

The IC chip 36*b* is arranged at a substantially center of a surface (upper face) of the base 36*a* when seen from the plan view. The IC chip 36*b* includes non-volatile memory (not shown). This memory stores unique identification information related to the toner container 10 and the toner. In this regard, the identification information includes a serial number and a manufacturing date of the toner container 10, a drive time (the number of rotations) of the conveyer 33 and the like, a toner color and a toner containing amount, for example.

The tag antenna 36*c* is electrically connected to the IC chip 36*b* so as to form an electrically closed circuit. The tag antenna 36*c* is arranged to transmit and receive information to and from the reader antenna 14*b* of the communication device 14. The tag antenna 36*c* is formed in a substantially whorled shape which revolves so as to draw a substantially square shape without overlapping at surroundings of the IC chip 36*b*. The tag antenna 36*c* is formed by coating (printing) a surface of the base 36*a* with a conductive ink in which a conductive material (such as metal powders such as gold, platinum or silver or carbon particles) is blended in a photocurable or thermosetting synthetic resin.

The cover 36*d* is arranged so as to cover the base 36*a* on which the IC chip 36*b* and the tag antenna 36*c* are arranged. The cover 36*d* is formed by using a resin material of good waterproofness and insulation property to protect the IC chip 36*b* and the tag antenna 36*c*.

Figure 8:
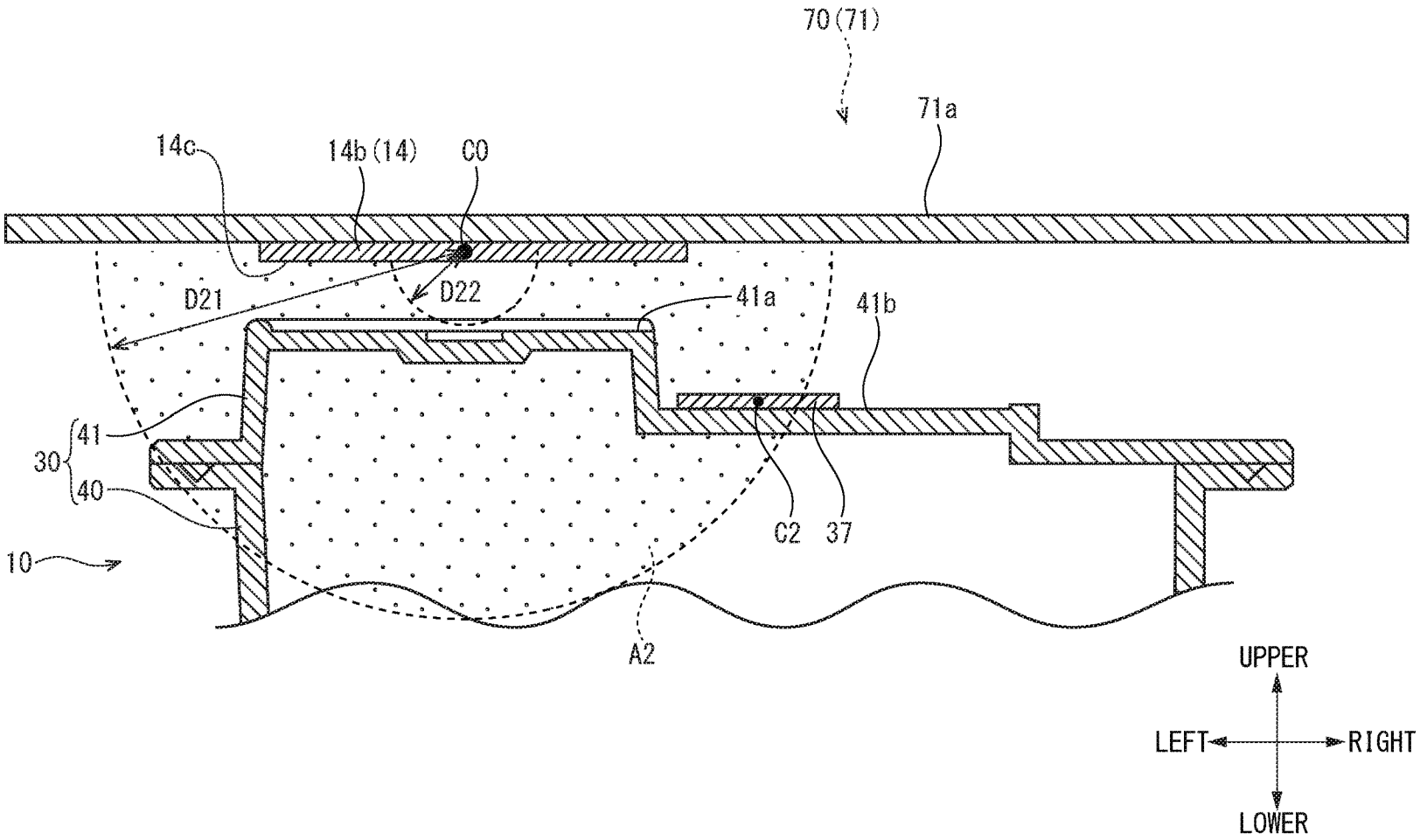
FIG. 8 is a sectional view schematically showing a second communicable area of the second RF tag of the toner container according to the embodiment of the present invention.

By the way, general RF tags including the RF tag 36 are configured to be able to make wireless communication with the communication device 14 within a semispherical communicable area around the communication device 14 (reader antenna 14*b*) as a center (C0) (see FIGS. 7 and 8). This communicable area is individually set per RF tag according to a specification of the RF tag. Further, according to the specification of the RF tag, a maximum communication distance which forms a maximum radius of an operable area, and a minimum communication distance which forms a minimum radius of the operable area are individually set. In this regard, the communicable area, the maximum communication distance and the minimum communication distance refer to a communicable area, a maximum communication distance and a minimum communication distance of the general RF tags including the RF tag 36.

The toner container 10 according to the present embodiment is mainly mounted on the popular color printer 1. Hence, the toner container 10 employs the low-cost RF tag 36 of a short maximum communication distance, for example. This toner container 10 is mounted on a highly functional image forming apparatus 70, too, in addition to the popular color printer 1 (see FIG. 8). In this case, the toner container 10 employs another RF tag 37 (referred to as the "second RF tag 37" below) instead of the RF tag 36 (referred to as the "first RF tag 36" below). The second RF tag 37 has a relatively long maximum communication distance and high security capability (confidentiality), for example. In this regard, the second RF tag 37 employs the same configuration as that of the above-mentioned RF tag 36, and is configured to include a base 37*a*, an IC chip 37*b*, a tag antenna 37*c* and a cover 37*d* (see FIG. 6).

As shown in FIG. 7, the first RF tag 36 has a first maximum communication distance D11 set to 3 mm, and a first minimum communication distance D12 set to 0 mm, for example. The first communicable area A1 of the first RF tag 36 is defined as a semispherical area (with a vertical section of a fan shape) whose radius is the first maximum communication distance D11, for example. Meanwhile, as shown in FIG. 8, the second RF tag 37 has a second communication maximum distance D21 set to 7.5 mm, and a second minimum communication distance D22 set to 1.5 mm, for example. The second communicable area A2 of the second RF tag 37 is defined by subtracting (removing) a semispherical area whose radius is the second minimum communication distance D22, from a semispherical area whose radius is the second maximum communication distance D21. That is, a vertical section of the second communicable area A2 is formed in an arch of a belt shape. In this regard, each of the communication distances D11 and D12 (each of the communication distances D21 and D22) is a linear distance from the center C0 on a plane of the reader antenna 14*b* to each of centers C1 and C2 on a plane of each of the tag antennas 36*c* and 37*c* (see FIGS. 7 and 8).

As described above, in the present embodiment, an RF tag is selected from the first RF tag 36 which makes wireless communication with the communication device 14 within the first communicable area A1, and the second RF tag 37 which makes wireless communication within the second communicable area A2.

The toner container 10 (case main body 30) according to the present embodiment includes the two attachment parts 41*a* and 41*b* which correspond to a plurality of RF tags of different specifications. That is, the first attachment part 41*a* and the second attachment part 41*b* are arranged in a row in a direction parallel to the communication device 14 and in a direction vertical to the communication device 14 to correspond to a plurality of different communicable areas. As described above, the first RF tag 36 is arranged at the first attachment part 41*a* (see FIG. 7). By contrast with this, when the toner container 10 (case main body 30) is applied to the image forming apparatus 70, the first RF tag 36 is removed, and the second RF tag 37 is arranged at the second attachment part 41*b* (see FIG. 8). The second RF tag 37 is applied on the second attachment part 41*b* by an adhesive layer (not shown) of the base 37*a*. That is, each of the RF tags 36 and 37 is arranged at one of the two attachment parts 41*a* and 41*b* according to each of the preset unique communicable areas A1 and A2.

In this regard, as shown in FIG. 8, an apparatus main body 71 of the image forming apparatus 70 includes an attachment part 71*a* to which the four toner containers 10 are detachably attached. At a rear upper part of the attachment part 71*a*, the communication device 14 employing the same configuration is arranged at the same position as that of the above-mentioned color printer 1. In addition, the image forming apparatus 70 employs the substantially same configuration as that of the above-mentioned color printer 1, and therefore will not be described in detail.

As shown in FIG. 7, the first RF tag 36 is arranged at the center C1 of the tag antenna 36*c* within the first communicable area A1, and is configured to be able to make wireless communication with the reader antenna 14*b*. Similarly, as shown in FIG. 8, the second RF tag 37 is arranged at the center C2 of the tag antenna 37*c* within the second communicable area A2, and is configured to be able to make wireless communication with the reader antenna 14*b*.

As shown in FIGS. 7 and 8, the first attachment part 41*a* and the second attachment part 41*b* are shifted with each other in the horizontal direction (the direction parallel to the opposed face 14*c* of the communication device 14) and in the vertical direction (the direction vertical to the opposed face 14*c* of the communication device 14). When it is assumed that the two RF tags 36 and 37 including the different communicable areas are arranged at the two attachment parts 41*a* and 41*b*, the respective RF tags 36 and 37 are arranged so that the centers C1 and C2 of the tag antennas 36*c* and 37*c* are arranged within the communicable areas A1 and A2.

According to the above configuration, the first RF tag 36 (or the second RF tag 37) of the two RF tags 36 and 37 of the different communicable areas (maximum and minimum communication distances) is arranged at the corresponding first attachment part 41*a* (or the second attachment part 41*b*) and can make appropriate wireless communication with the communication device 14. That is, it is possible to improve reliability of wireless communication. Further, by arranging the two attachment parts 41*a* and 41*b* in the case main body 30, it is possible to clearly show the operator the positions where the RF tags 36 and 37 are attached. Consequently, it is possible to prevent the operator from mistaking the attachment positions of the RF tags 36 and 37.

Next, an operation between the communication device 14 and the first RF tag 36 will be described with reference to FIG. 5. When the toner container 10 is attached to the attachment part 2*a*, the first RF tag 36 is arranged right below the communication device 14. The reader antenna 14*b* of the communication device 14 dispatches information stored in memory (not shown) of the reader substrate 14*a*, on a radio wave or a magnetic field (also referred to as the "radio wave and the like" below).

The tag antenna 36*c* of the first RF tag 36 generates electric power by rectifying the received radio wave (or by resonating the magnetic field). The IC chip 36*b* operates by the generated electric power. The tag antenna 36*c* returns the identification information stored in the memory of the IC chip 36*b* on the radio wave and the like.

The reader antenna 14*b* receives the two radio waves and the like returned from the tag antenna 36*c*. The reader substrate 14*a* reads the identification information from the received radio wave and the like. Further, the reader substrate 14*a* transmits the read identification information to the controller 9 (see FIG. 2).

The controller 9 (arithmetic processor) executes various types of control such as image forming processing based on the identification information. Further, the controller 9 (arithmetic processor) determines whether or not the toner container 10 and the toner contained in the toner container 10 are genuine products based on this identification information. In this regard, the controller 9 displays a determination result on a liquid crystal display (not shown) arranged on an upper front face of the apparatus main body 2, for example.

In this regard, the operation between the communication device 14 and the second RF tag 37 is the same as the operation of the first RF tag 36 mentioned above, and therefore will not be described. In this regard, the communication device 14 (reader substrate 14*a*) has only a reading function yet may include a writing function of writing information in the memory of each of the RF tags 36 and 37 in addition to the reading function.

As to the toner container 10 according to the above-mentioned present embodiment, the first attachment part 41*a* and the second attachment part 41*b* are stereoscopically (three-dimensionally) shifted with each other, so that the distance between each of the attachment parts 41*a* and 41*b* and the communication device 14 is changed per attachment parts 41*a* and 41*b*. The first RF tag 36 (second RF tag 37) is attached to the first attachment part 41*a* (second attachment part 41*b*) selected in accordance with the communicable area A1 (A2). Consequently, it is possible to easily change the specification of the RF tag (change the communicable area (communication distance)) without changing the design of the case main body 30. According to this, it is possible to apply the single case main body 30 to a plurality of types of image forming apparatuses (the color printer 1, the image forming apparatus 70 and the like). According to this, it is possible to avoid the design change of the case main body 30, and consequently reduce manufacturing cost of the case main body 30.

Further, the first RF tag 36 (second RF tag 37) is arranged at the first attachment part 41*a* of the two attachment parts 41*a* and 41*b*, and consequently can make wireless communication with the single communication device 14. According to this, it is not necessary to change the position of the communication device 14 or exchange the communication device 14 due to a change of the specification of the RF tag, and consequently reduce cost and an installation space for installing the communication device 14. According to this, it is possible to make the apparatus main body 2 smaller.

In this regard, the toner container 10 according to the present embodiment includes the two attachment parts 41*a* and 41*b*. However, the present invention is not limited to this. Two or more attachment parts may be formed according to the number of RF tags to be arranged. Further, the first attachment part 41*a* and the second attachment part 41*b* are adjacently arranged in the left and right direction, but they may be adjacently arranged in the front and rear direction.

In this regard, the toner container 10 according to the present embodiment has the two attachment parts 41*a* and 41*b* (two RF tags 36 and 37) on the upper face. However, the present invention is not limited to this. When, for example, the communication device 14 is arranged on a rear face of the attachment part 2*a*, the two attachment parts 41*a* and 41*b* (two RF tags 36 and 37) are preferably arranged on the sidewall 43B of the toner container 10.

In addition, the above-mentioned embodiment describes one aspect of the developer case according to the present invention and the image forming apparatus which includes the developer case. The technical scope of the present invention is not limited to the above embodiment. The components in the above-mentioned embodiment can be optionally replaced or combined with existing components, and the description of the above-mentioned embodiment does not limit the contents of the invention recited in the claims.

The invention claimed is:

1. A developer case comprising:

a case main body containing developer and attached to an apparatus main body which includes a communication device; and an RF tag arranged at the case main body and making wireless communication with the communication device within a communicable area around the communication device, wherein the case main body includes a plurality of attachment parts opposed to the communication device in a state where the case main body is attached to the apparatus main body, and the RF tag is arranged at one of the plurality of attachment parts according to the communicable area unique to the RF tag, wherein the RF tag is selected from a first RF tag making the wireless communication with the communication device within a first communicable area and a second RF tag making the wireless communication with the communication device within a second communicable area, the plurality of attachment parts include:

a first attachment part at which the first RF tag is arranged; and a second attachment part at which the second RF tag is arranged, and the communication device has an opposed face opposed to the first attachment part and the second attachment part, and the first attachment part and the second attachment part are shifted with each other in a direction parallel to the opposed face and in a direction vertical to the opposed face.

2. The developer case according to claim 1, wherein the RF tag includes:

an IC chip storing unique information; and a tag antenna electrically connected to the IC chip, and a center of the tag antenna is arranged within the communicable area.

3. An image forming apparatus comprising:

an apparatus main body which includes a communication device; and the developer case according to claim 1, the developer case being attached to the apparatus main body.

4. A developer case comprising:

a case main body containing developer and attached to an apparatus main body which includes a communication device; and an RF tag arranged at the case main body and making wireless communication with the communication device within a communicable area around the communication device, wherein the case main body includes a plurality of attachment parts opposed to the communication device in a state where the case main body is attached to the apparatus main body, and the RF tag is arranged at one of the plurality of attachment parts according to the communicable area unique to the RF tag, wherein the plurality of attachment parts include:

a first attachment part formed right below the communication device; and a second attachment part arranged adjacently to the first attachment part and shifted downward with respect to the first attachment part, and a fitting recess in which the RF tag is arrangeable is recessed at the first attachment part.

5. An image forming apparatus comprising:

an apparatus main body which includes a communication device; and the developer case according to claim 4, the developer case being attached to the apparatus main body.

6. A developer case comprising:

a case main body containing developer and attached to an apparatus main body which includes a communication device; and an RF tag arranged at the case main body and making wireless communication with the communication device within a communicable area around the communication device, wherein the case main body includes a plurality of attachment parts opposed to the communication device in a state where the case main body is attached to the apparatus main body, and the RF tag is arranged at one of the plurality of attachment parts according to the communicable area unique to the RF tag, wherein the case main body includes:

a storing case formed in a box shape with an opened upper face; and a lid sealing the upper face of the storing case, and the plurality of attachment parts are formed on an upper face of the lid.

7. The developer case according to claim 6, wherein a step is formed at the lid between the plurality of attachment parts.

8. An image forming apparatus comprising:

an apparatus main body which includes a communication device; and the developer case according to claim 6, the developer case being attached to the apparatus main body.

* * * * *